US009593851B2

(12) United States Patent
Shershnyov et al.

(10) Patent No.: US 9,593,851 B2
(45) Date of Patent: Mar. 14, 2017

(54) COMBUSTOR AND METHOD OF SUPPLYING FUEL TO THE COMBUSTOR

(75) Inventors: Borys Borysovych Shershnyov, Moscow (RU); Geoffrey David Myers, Simpsonville, SC (US); Leonid Yulyevich Ginesin, Moscow (RU)

(73) Assignee: General Electric Company, Schenectady, NY (US)

( * ) Notice: Subject to any disclaimer, the term of this patent is extended or adjusted under 35 U.S.C. 154(b) by 458 days.

(21) Appl. No.: 14/122,697

(22) PCT Filed: Jun. 30, 2011

(86) PCT No.: PCT/RU2011/000494

§ 371 (c)(1),
(2), (4) Date: Nov. 27, 2013

(87) PCT Pub. No.: WO2013/002669

PCT Pub. Date: Jan. 3, 2013

(65) Prior Publication Data

US 2014/0137566 A1 May 22, 2014

(51) Int. Cl.
*F23R 3/28* (2006.01)
*F23R 3/34* (2006.01)
(Continued)

(52) U.S. Cl.
CPC ..... *F23R 3/28* (2013.01); *F23D 11/408* (2013.01); *F23R 3/283* (2013.01); *F23R 3/346* (2013.01); *F23R 3/54* (2013.01)

(58) Field of Classification Search
CPC .. F23R 3/283; F23R 3/286; F23R 3/34; F23R 3/346
See application file for complete search history.

(56) References Cited

U.S. PATENT DOCUMENTS 2,922,279 A 1/1960 Roberson et al.
3,934,409 A 1/1976 Quillevere et al.
(Continued)

FOREIGN PATENT DOCUMENTS

CH 666340 A5 * 7/1988 ..... F02C 7/222
EP 2236935 6/2010
(Continued)

OTHER PUBLICATIONS

Co-pending U.S. Appl. No. 13/417,405, Chen et al., filed Mar. 12, 2012.
(Continued)

*Primary Examiner* — Phutthiwat Wongwian
*Assistant Examiner* — Rene Ford
(74) *Attorney, Agent, or Firm* — Dority & Manning, P.A.

(57) ABSTRACT

A combustor (10) includes a combustion chamber (18), a liner (12) surrounding the combustion chamber, and a flow sleeve (52) surrounding the liner. An annular passage is between the liner and the flow sleeve, and a fuel injector (50) is located partially in the annular passage and extending through the liner into the combustion chamber. The fuel injector includes an outer tube, an inner tube, and a flow passage. A method of supplying a fuel to a combustor includes flowing a diluent inside an outer tube extending along a liner and flowing a liquid or gaseous fuel inside an inner tube extending inside a portion of the outer tube. The method further includes flowing the diluent and the liquid or gaseous fuel through the liner and into a combustion chamber surrounded by the liner.

15 Claims, 7 Drawing Sheets

(51) Int. Cl.

| | |
|---|---|
| ***F02C 7/22*** | (2006.01) |
| ***F23D 11/40*** | (2006.01) |
| ***F23R 3/54*** | (2006.01) |

(56) References Cited

U.S. PATENT DOCUMENTS

| | | | | |
|---|---|---|---|---|
| 4,040,252 | A | 8/1977 | Mosier et al. | |
| 4,045,956 | A | 9/1977 | Markowski et al. | |
| 4,112,676 | A | 9/1978 | DeCorso | |
| 4,253,301 | A | 3/1981 | Vogt | |
| 4,288,980 | A | 9/1981 | Ernst | |
| 4,527,386 | A * | 7/1985 | Markowski | F02C 7/18 60/751 |
| 4,751,815 | A | 6/1988 | Moore | |
| 4,875,339 | A | 10/1989 | Rasmussen et al. | |
| 4,928,481 | A | 5/1990 | Joshi et al. | |
| 5,054,280 | A | 10/1991 | Ishibashi et al. | |
| 5,099,644 | A | 3/1992 | Sabla et al. | |
| 5,127,229 | A | 7/1992 | Ishibashi et al. | |
| 5,297,391 | A | 3/1994 | Roche | |
| 5,321,948 | A | 6/1994 | Leonard | |
| 5,450,725 | A | 9/1995 | Takahara et al. | |
| 5,623,819 | A | 4/1997 | Bowker et al. | |
| 5,749,219 | A | 5/1998 | DuBell | |
| 5,974,781 | A | 11/1999 | Correa et al. | |
| 6,047,550 | A | 4/2000 | Beebe | |
| 6,178,737 | B1 | 1/2001 | Lenertz et al. | |
| 6,192,688 | B1 | 2/2001 | Beebe | |
| 6,253,538 | B1 | 7/2001 | Sampath et al. | |
| 6,755,024 | B1 * | 6/2004 | Mao | F23D 11/107 239/416 |
| 6,868,676 | B1 | 3/2005 | Haynes | |
| 6,925,809 | B2 | 8/2005 | Mowill | |
| 6,935,116 | B2 | 8/2005 | Stuttaford et al. | |
| 7,137,256 | B1 | 11/2006 | Stuttaford et al. | |
| 7,162,875 | B2 | 1/2007 | Fletcher et al. | |
| 7,237,384 | B2 | 7/2007 | Stuttaford et al. | |
| 7,425,127 | B2 | 9/2008 | Zinn | |
| 7,665,309 | B2 | 2/2010 | Parker et al. | |
| 8,475,160 | B2 | 7/2013 | Campbell et al. | |
| 2005/0095542 | A1 | 5/2005 | Sanders et al. | |
| 2005/0097889 | A1 | 5/2005 | Pilatis et al. | |
| 2007/0022758 | A1 | 2/2007 | Myers et al. | |
| 2007/0137207 | A1 | 6/2007 | Mancini et al. | |
| 2009/0084082 | A1 | 4/2009 | Martin et al. | |
| 2010/0018208 | A1 | 1/2010 | Ritland | |
| 2010/0018209 | A1 | 1/2010 | Ramier et al. | |
| 2010/0174466 | A1 | 7/2010 | Davis, Jr. et al. | |
| 2011/0056206 | A1 | 3/2011 | Wiebe | |
| 2011/0067402 | A1 | 3/2011 | Wiebe et al. | |
| 2011/0131998 | A1 | 6/2011 | Nadkarni et al. | |
| 2011/0179803 | A1 | 7/2011 | Berry et al. | |
| 2011/0296839 | A1 | 12/2011 | Van Nieuwenhuizen et al. | |
| 2013/0008169 | A1 | 1/2013 | Belsom et al. | |

FOREIGN PATENT DOCUMENTS

| | | | | |
|---|---|---|---|---|
| EP | 2206964 | A2 | 7/2012 | |
| EP | 2613082 | | 10/2013 | |
| FR | 1186524 | A * | 8/1959 | F23D 11/36 |
| JP | 2006138566 | | 6/2006 | |
| WO | WO 2004/035187 | A2 | 4/2004 | |

OTHER PUBLICATIONS

Co-pending U.S. Appl. No. 13/349,886, Stoia, et al., filed Jan. 13, 2012.

Co-pending U.S. Appl. No. 13/344,877, Stoia, et al., filed Jan. 6, 2012.

Co-pending U.S. Appl. No. 13/349,906, Stoia, et al., filed Jan. 13, 2012.

Co-pending U.S. Appl. No. 13/420,715, Chen, et al., filed Mar. 15, 2012.

Co-pending U.S. Appl. No. 13/455,429, Romig, et al., filed Apr. 25, 2012.

Co-pending U.S. Appl. No. 13/455,480, Stoia, et al., filed Apr. 25, 2012.

Co-pending U.S. Appl. No. 14/122,694, Shershnyov, filed Nov. 27, 2013.

Co-pending U.S. Appl. No. 13/466,184, Melton, et al. filed May 8, 2012.

PCT International Written Opinion and Search Report for application PCT/RU2011/000494 dated Mar. 27, 2012.

Unofficial English Translation of Chinese Office Action issued in connection with corresponding CN Application No. 201180071974.3 on Nov. 28, 2014.

* cited by examiner

COMBUSTOR AND METHOD OF SUPPLYING FUEL TO THE COMBUSTOR

FIELD OF THE INVENTION

The present invention generally involves a combustor and method for supplying fuel to the combustor.

BACKGROUND OF THE INVENTION

Gas turbines are widely used in industrial and power generation operations. A typical gas turbine may include an axial compressor at the front, one or more combustors around the middle, and a turbine at the rear. Ambient air enters the compressor, and rotating blades and stationary vanes in the compressor progressively impart kinetic energy to the air to produce a compressed working fluid at a highly energized state. The compressed working fluid exits the compressor and flows through nozzles in the combustors where it mixes with fuel and ignites to generate combustion gases having a high temperature and pressure. The combustion gases expand in the turbine to produce work. For example, expansion of the combustion gases in the turbine may rotate a shaft connected to a generator to produce electricity.

The fuel supplied to the combustor may be a liquid fuel, a gaseous fuel, or a combination of liquid and gaseous fuels. For example, possible liquid fuels supplied to the combustor may include fuel oil, naptha, petroleum, coal tar, crude oil, and gasoline, and possible gaseous fuels supplied to the combustor may include blast furnace gas, coke oven gas, natural gas, methane, vaporized liquefied natural gas (LNG), hydrogen, syngas, and propane. If the liquid and/or gaseous fuel is not evenly mixed with the air prior to combustion, localized hot spots may form in the combustor. The localized hot spots may increase the production of undesirable NOx emissions and may increase the chance for the flame in the combustor to flash back into the nozzles and/or become attached inside the nozzles which may damage the nozzles. Although flame flash back and flame holding may occur with any fuel, they occur more readily with high reactive fuels, such as hydrogen, that have a higher burning rate and a wider flammability range.

A variety of techniques exist to allow higher operating combustor temperatures while minimizing NOx emissions, flash back, and flame holding. Many of these techniques seek to reduce localized hot spots to reduce the production of NOx and/or reduce low flow zones to prevent or reduce the occurrence of flash back or flame holding. For example, continuous improvements in nozzle designs result in more uniform mixing of the fuel and air prior to combustion to reduce or prevent localized hot spots from forming in the combustor. Alternately, or in addition, nozzles have been designed to ensure a minimum flow rate of fuel and/or air through the nozzle to cool the nozzle surfaces and/or prevent the combustor flame from flashing back into the nozzle. However, the improved nozzle designs typically result in increased manufacturing costs and/or continued additional parts or components added to the combustor that increase the differential pressure across the combustor, thus detracting from the overall efficiency of the gas turbine. Therefore, improvements in combustor designs to enhance the mixing of fuel and air prior to combustion and/or cool the combustor surfaces would be useful. In addition, combustor designs that may readily switch between various combinations of liquid and gaseous fuels would be useful.

BRIEF DESCRIPTION OF THE INVENTION

Aspects and advantages of the invention are set forth below in the following description, or may be obvious from the description, or may be learned through practice of the invention.

One embodiment of the present invention is a combustor that includes a combustion chamber, a liner surrounding at least a portion of the combustion chamber, and a flow sleeve surrounding at least a portion of the liner. An annular passage is between the liner and the flow sleeve, and a fuel injector is located at least partially in the annular passage and extending through the liner into the combustion chamber. The fuel injector includes an outer tube, an inner tube inside the outer tube, and a flow passage between the inner tube and the outer tube.

Another embodiment of the present invention is a combustor that includes a combustion chamber, a liner surrounding at least a portion of the combustion chamber, and a flow sleeve surrounding at least a portion of the liner. An annular passage is between the liner and the flow sleeve. An outer tube extends through the flow sleeve, along at least a portion of the annular passage, and through the liner into the combustion chamber. An inner tube extends inside at least a portion of the outer tube, and at least one of a liquid or gaseous fuel supply outside of the annular passage is in fluid communication with the inner tube.

Particular embodiments of the present invention may also include a method of supplying a fuel to a combustor. The method includes flowing a diluent inside an outer tube extending along at least a portion of a liner and flowing at least one of a liquid or gaseous fuel inside an inner tube extending inside at least a portion of the outer tube. The method further includes flowing the diluent and the liquid or gaseous fuel through the liner and into a combustion chamber surrounded by the liner.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
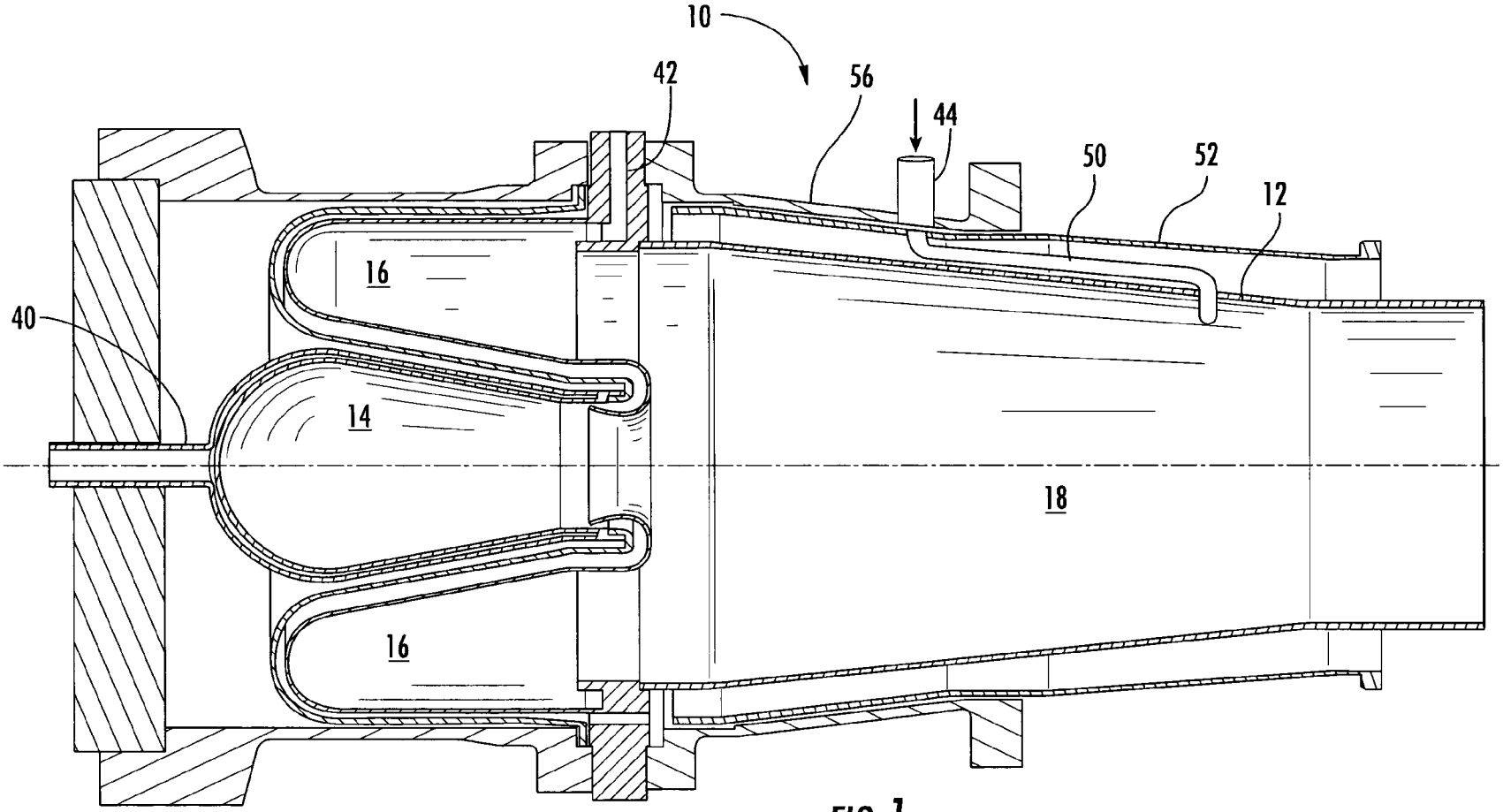
FIG. 1 is a simplified side cross-section view of an exemplary combustor according to one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a combustor that enhances the mixing of liquid and/or gaseous fuels with air prior to combustion to reduce the emissions and/or peak combustion gas temperatures. In particular embodiments, the combustor may include one or more pre-mix chambers that enhance the mixing of the liquid and/or gaseous fuels with the air prior to combustion. Alternately, or in addition, the combustor may include one or more late lean fuel injectors downstream of the pre-mix chamber(s) that supply additional liquid and/or gaseous fuels to the combustor. As a result, the combustor may be capable of operating with liquid or gaseous fuels during extended turndown operations without exceeding emissions limits, may have enhanced safety margins in the event of a flame holding or flash back occurrence, and/or may have longer intervals between preventative and/or corrective maintenance.

FIG. 1 provides a simplified side cross-section view of an exemplary combustor 10 according to one embodiment of the present invention; however, one of ordinary skill in the art will readily appreciate that the present invention in not limited to any particular combustor design or configuration, unless specifically recited in the claims. As shown, the combustor 10 may generally include a liner 12 and first and second pre-mix chambers 14, 16 that generally define or surround at least a portion of a combustion chamber 18. The liner 12 may be rolled and welded, forged, or cast from suitable materials capable of continuous exposure to the maximum anticipated temperatures associated with the combustion gases produced by the combustor 10. For example, the liner 12 may be made from a steel alloy or superalloy such as Inconel or Rene.

The combustor 10 may further include one or more fuel plenums that supply fuel for combustion. For example, as best shown in FIG. 1, the combustor 10 may include first, second, and third fuel plenums 40, 42, 44. The first fuel plenum 40 may comprise a supply of fuel in fluid communication with the first pre-mix chamber 14. The second fuel plenum 42 may comprise an annular fuel manifold surrounding the combustor 10 in fluid communication with the second pre-mix chamber 16. Fuel from the second fuel plenum 42 may flow through metering ports directly into the second pre-mix chamber 16. As shown most clearly in FIG. 1, the third fuel plenum 44 may similarly comprise an annular fuel manifold surrounding the combustor 10 in fluid communication with the combustion chamber 18. Fuel from the third fuel plenum 44 may flow into a fuel injector 50 that mixes the fuel with the compressed working fluid and injects the mixture through the liner 12 and into the combustion chamber 18. In this manner, at least a portion of the third fuel plenum 44 may surround at least a portion of the liner 12 so that fuel may flow over the liner 12 to remove heat from the outer surface of the liner 12 before entering the combustion chamber 18.

FIGS. 2, 3, 4, and 5 provide enlarged views of the third fuel plenum 44 and fuel injector 50 shown in FIG. 1 according to various embodiments of the present invention. As shown in the figures, a flow sleeve 52 may surround at least a portion of the liner 12 to define an annular passage 54 between the liner 12 and the flow sleeve 52, and a casing 56 may surround at least a portion of the combustor 10 to contain the compressed working fluid. A portion of the compressed working fluid may thus flow through the annular passage 54 along the outside of the liner 12 to remove heat from the liner 12 prior to entering the combustion chamber 18 through the second pre-mix chamber 16.

Figure 2:
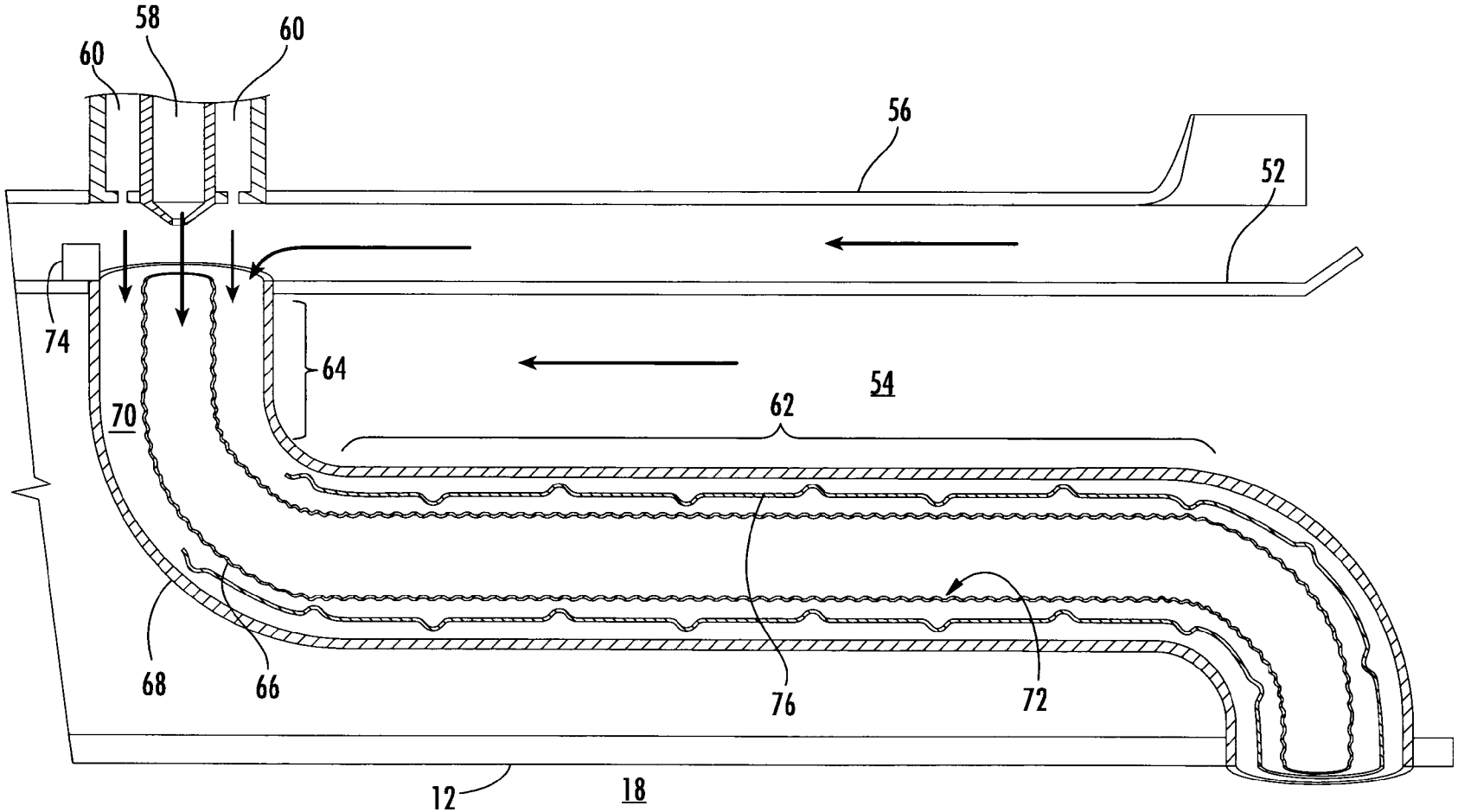
FIG. 2 is an enlarged cross-section view of the fuel injector shown in FIG. 1 according to one embodiment of the present invention.
Figure 3:
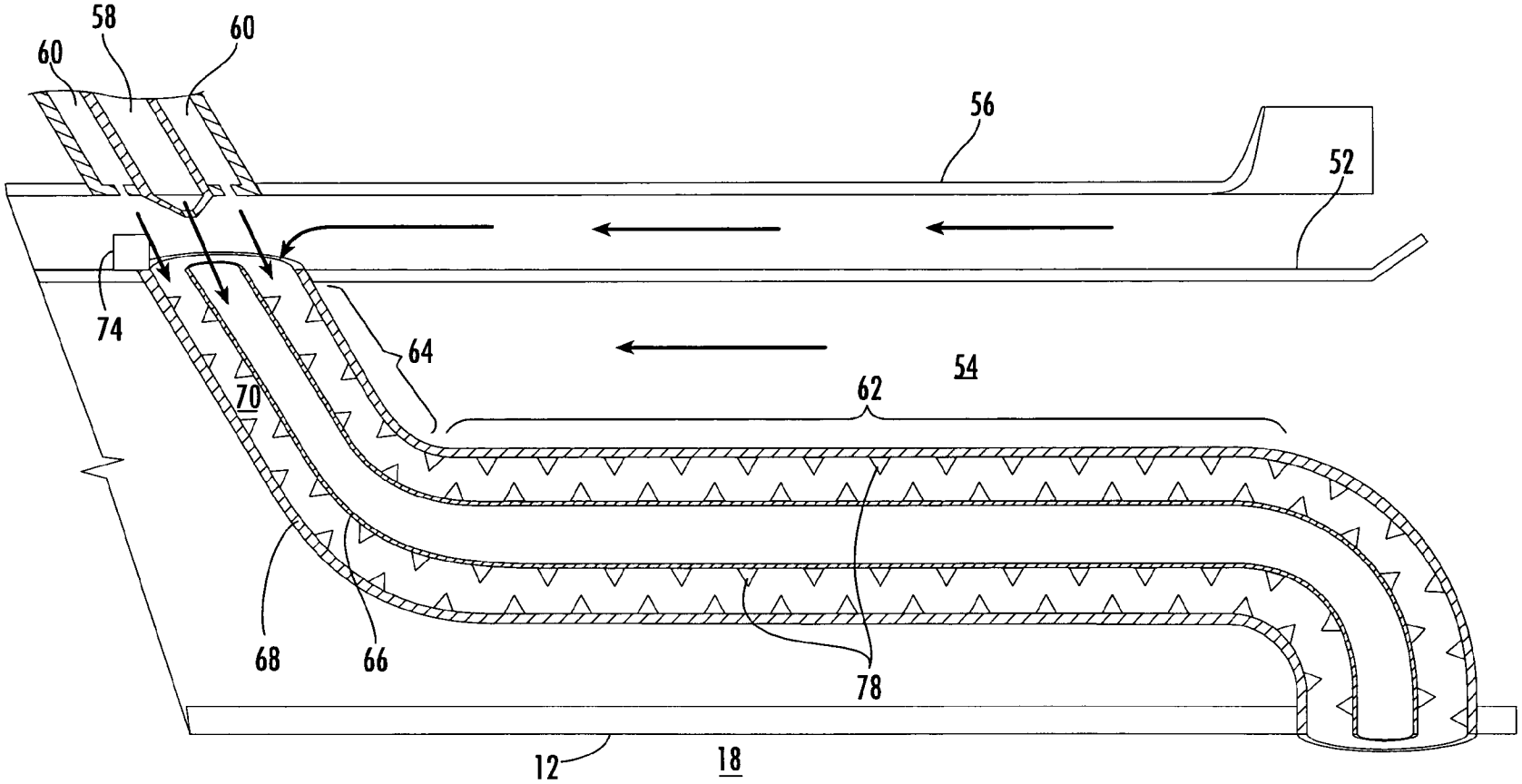
FIG. 3 is an enlarged cross-section view of the fuel injector shown in FIG. 1 according to a second embodiment of the present invention.
Figure 4:
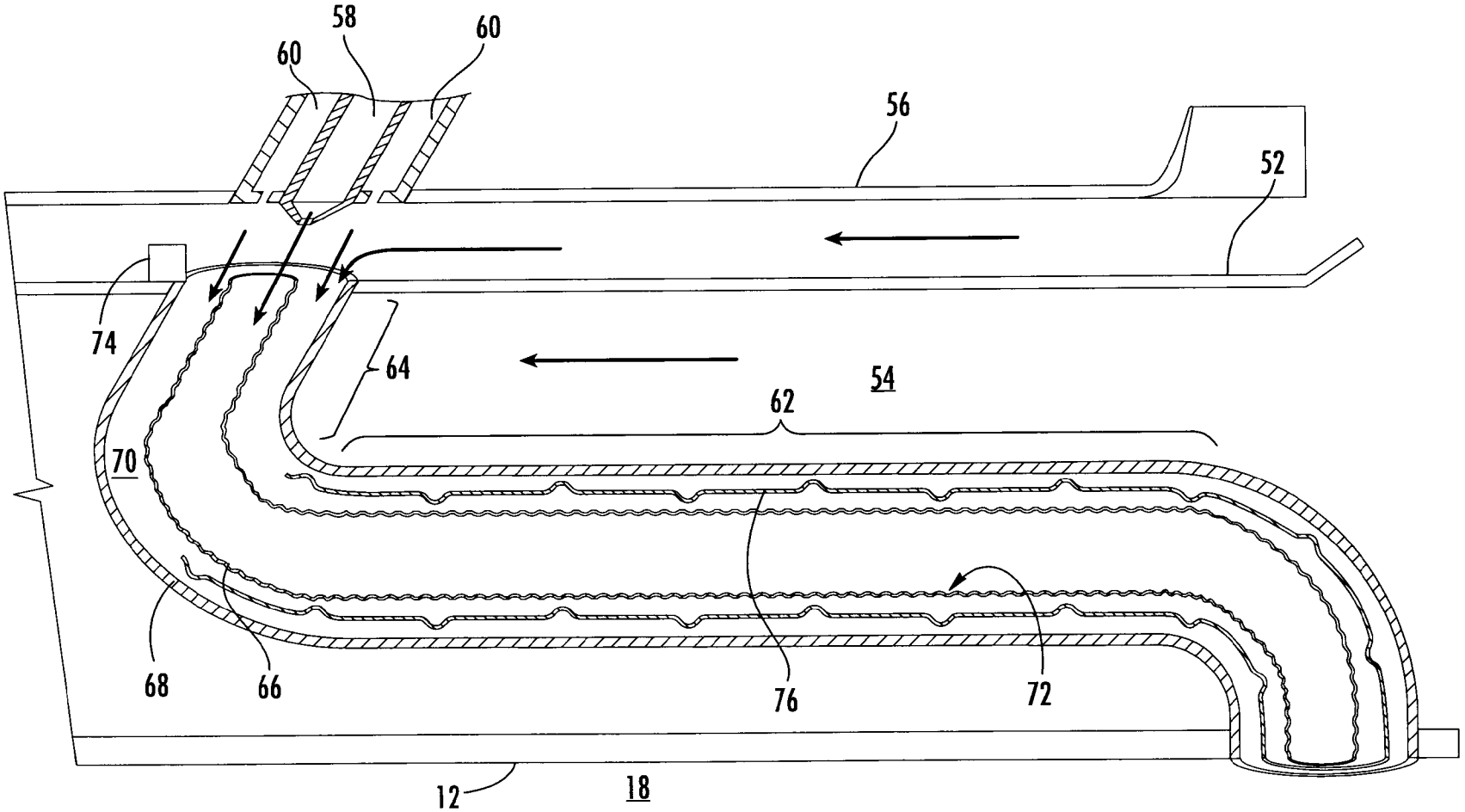
FIG. 4 is an enlarged cross-section view of the fuel injector shown in FIG. 1 according to a third embodiment of the present invention.

The third fuel plenum 44 may be connected to a liquid fuel supply 58 and/or a gaseous fuel supply 60 located outside of the annular passage 54 so that the third fuel plenum 44 may provide fluid communication with the fuel injector 50. A portion of the fuel injector 50 may be located at least partially in the annular passage 54, allowing the fuel injector 50 to extend through the liner 12 and into the combustion chamber 18. For example, the fuel injector 50 may include a first section 62 substantially parallel to the liner 12 and a second section 64 substantially perpendicular to the first section 62, as shown in FIG. 2. In alternate embodiments, the second section 64 may be connected to the first section 62 at an obtuse angle, as shown in FIG. 3, or at an acute angle, as shown in FIG. 4.

As shown most clearly in FIGS. 2-5, the fuel injector 50 may include an inner tube 66, an outer tube 68, and a flow passage 70 between the inner tube 66 and the outer tube 68. The inner tube 66 is generally coaxial with and located inside of the outer tube 68. An inside surface of the inner tube 66 may be coated with an oleo phobic coating (not visible) and/or a dimpled texture 72 to resist the build-up or caking of fuel flowing through the inner tube 66. The outer tube 68 may extend through the flow sleeve 52, along at least a portion of the annular passage 54, and through the liner 12 into the combustion chamber 18. The outer tube 68 may further include a flow guide 74 extending radially outward from the outer tube 68 and the flow sleeve 52 to scoop or inject a portion of the compressed working fluid or a diluent into the flow passage 70. In this manner, the third fuel plenum 44 may supply liquid and/or gaseous fuel to the inner and/or outer tubes 66, 68 of the fuel injector 70, and a portion of the compressed working fluid or other diluent may flow through the flow passage 70 between the inner and outer tubes 66, 68 to pre-heat the fuel prior to being injected into the combustion chamber 18. Specifically, the compressed working fluid or diluent flowing through the flow passage 70 may evaporate the liquid fuel flowing through the inner tube 66 prior to reaching the liner 12 and being injected into the combustion chamber 18.

In particular embodiments, the fuel injector 50 may further include structure between the inner tube 66 and the outer tube 68 to disrupt the laminar flow of the compressed working fluid or diluent flowing through the flow passage 70 to increase the heat transfer from the compressed working fluid to the fuel. For example, FIGS. 2 and 4 illustrate a baffle 76 between the inner and outer tubes 66, 68. The baffle 76 may include a corrugated or perforated surface to disrupt the laminar flow of the compressed working fluid or diluent in the flow channel 70. Alternately, or in addition, as shown in FIG. 3, one or more turbulators 78 in the flow passage 70 between the inner and outer tubes 66, 68 may similarly disrupt the formation of a laminar layer to enhance the heat transfer from the compressed working fluid or diluent to the fuel.

Figure 5:
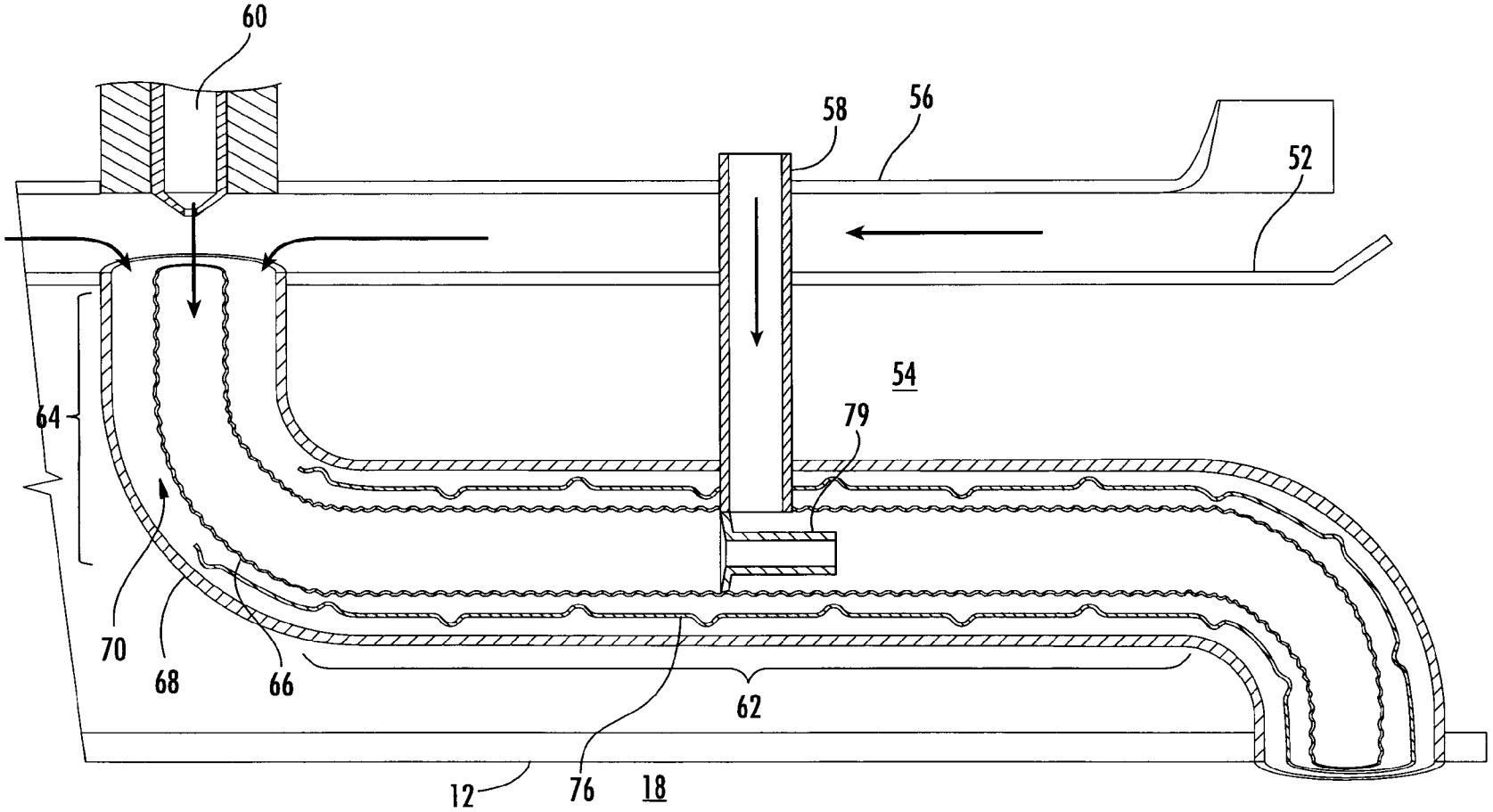
FIG. 5 is an enlarged cross-section view of the fuel injector shown in FIG. 1 according to a fourth embodiment of the present invention.

In the particular embodiment shown in FIG. 5, the third fuel plenum 44 provides fluid communication from the gaseous fuel supply 60 to the fuel injector 50, and the liquid fuel supply 58 extends separately through the flow sleeve 52 and the outer tube 68 to provide fluid communication with the inner tube 66. In this manner, the third fuel plenum 44 supplies the gaseous fuel 60 to the fuel injector 50, and the liquid fuel supply 58 separately supplies the liquid fuel to the fuel injector 50. As shown in FIG. 5, a pre-filming or air blast member 79, such as a conical, cylindrical, or curved meridian shape ring, may be inserted inside the inner tube 66. The liquid fuel supplied to the fuel injector 50 forms on the member 79 and is dispersed or broken up into droplets by the compressed working fluid or gaseous fuel flowing through the inner tube 66 to facilitate evaporation of the liquid fuel before reaching the liner 12 and being injected into the combustion chamber 18 along with the gaseous fuel.

Figure 6:
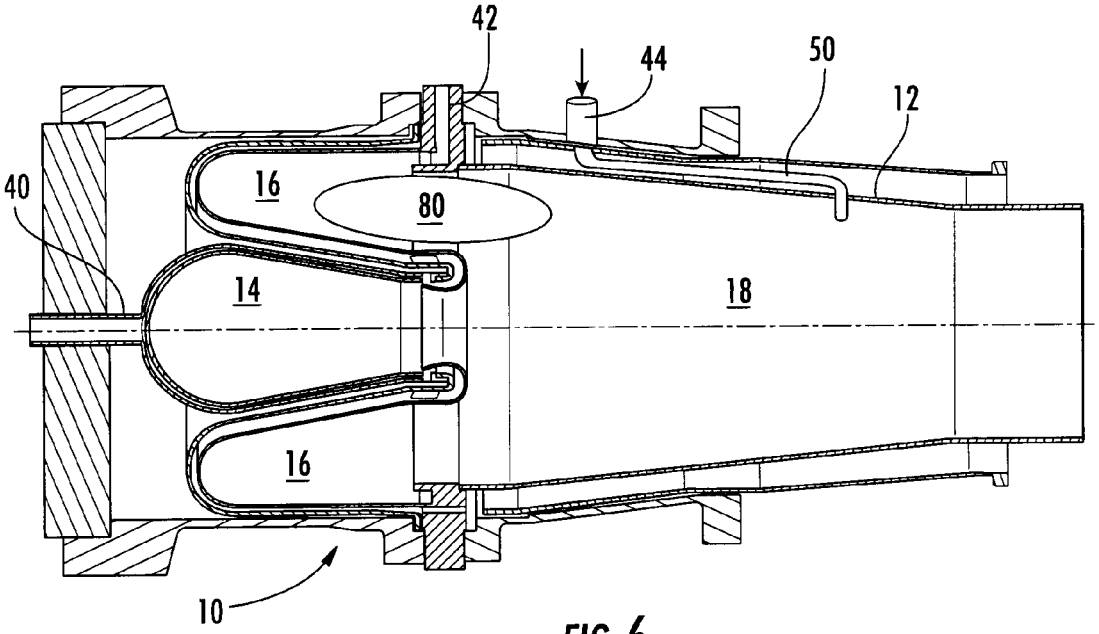
FIG. 6 is a simplified side cross-section view of the combustor shown in FIG. 1 during ignition or turndown operations.
Figure 7:
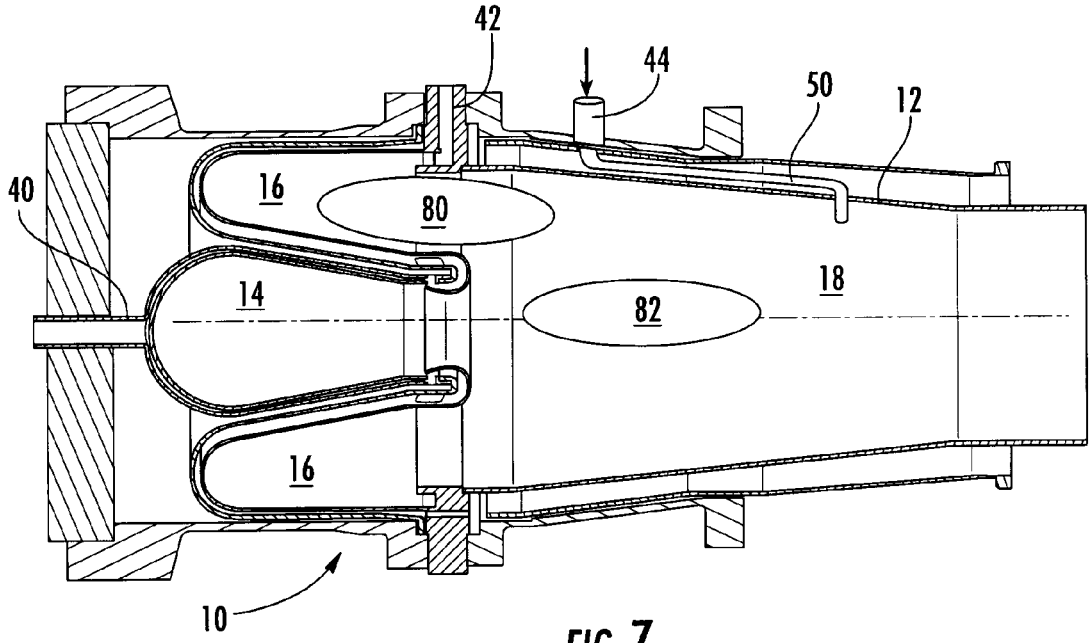
FIG. 7 is a simplified side cross-section view of the combustor shown in FIG. 1 during partial load operations.
Figure 8:
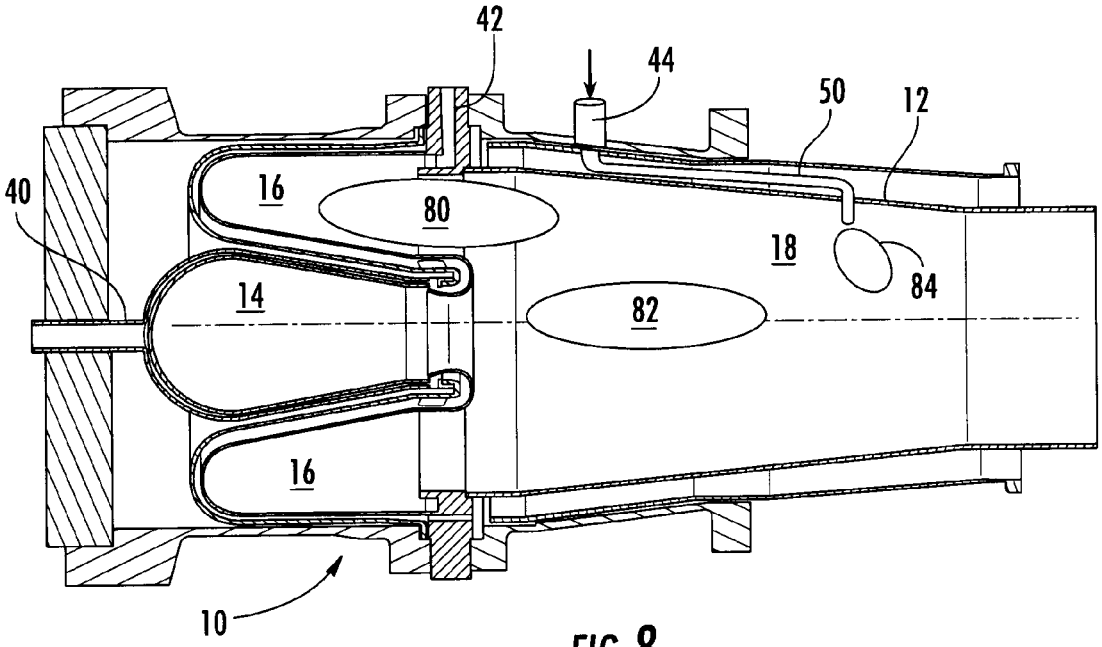
FIG. 8 is a simplified side cross-section view of the combustor shown in FIG. 1 during full load operations.

FIGS. 6-8 illustrate the flexibility of embodiments of the present invention to readily operate with liquid and/or gaseous fuels 58, 60 in various operating regimes without exceeding emissions limits and/or peak operating temperatures. For example, FIG. 6 provides a simplified side cross-section view of the combustor 10 during ignition or turndown operations. In this particular operating scheme, no fuel is supplied through either the first or third fuel plenums 40, 44, and fuel is only supplied from the second fuel plenum 42 to the second pre-mix chamber 16. As shown in FIG. 6, the mass flow rate and velocity of the fuel-air mixture flowing through the second pre-mix chamber 16 maintains a first flame 82 in the general vicinity of the exhaust of the second pre-mix chamber 16, with the precise location of the first flame 82 dependent on the actual power level of the combustor 10 at ignition or during turndown.

FIG. 7 shows the combustor 10 being operated during partial load operations. During partial load operations, the second fuel plenum 42 supplies fuel to the second pre-mix chamber 16, and the first fuel plenum 40 supplies fuel to the first pre-mix chamber 14 in one or more combustors 10 included in the gas turbine, with the number of combustors 10 receiving fuel from the first fuel plenum 40 dependent on the actual power level of the gas turbine. As previously described with respect to FIG. 6, the mass flow rate and velocity of the fuel-air mixture flowing through the second pre-mix chamber 16 maintains the first flame 82 in the general vicinity of the exhaust of the second pre-mix chamber 16. In addition, the mass flow rate and velocity of the fuel-air mixture flowing through the first pre-mix chamber 14 maintains a second flame 84 downstream of the first flame 82 in the combustion chamber 18, with the precise location dependent on the actual power level of the combustor 10.

FIG. 8 shows the combustor 10 being operated during full load operations. In this particular operating scheme, the first, second, and third fuel plenums 40, 42, 44 each supply fuel for combustion. Specifically, the first fuel plenum 40 supplies fuel to the first pre-mix chamber 14, and the second fuel plenum 42 supplies fuel to the second pre-mix chamber 16, as previously described with respect to FIG. 7. In addition, the third fuel plenum 44 supplies fuel to mix with air in the fuel injector 50 before being injected through the liner 12 directly into the combustion chamber 18, creating a third flame 86 in the combustion chamber 18.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal languages of the claims.

What is claimed is:

1. A combustor comprising:

a. a combustion chamber;

b. a liner surrounding at least a portion of the combustion chamber;

c. a flow sleeve surrounding at least a portion of the liner;

d. an annular passage between the liner and the flow sleeve;

e. a fuel injector located at least partially in the annular passage and extending through the liner into the combustion chamber, wherein the fuel injector comprises an outer tube, an inner tube inside the outer tube, and a flow passage between the inner tube and the outer tube; and f. a casing surrounding at least a portion of the flow sleeve, wherein compressed working fluid used in the combustion chamber flows between the casing and the flow sleeve;

wherein the outer tube comprises an open end extending through the flow sleeve such that a portion of the compressed working fluid between the casing and the flow sleeve flows into the flow passage, the outer tube comprising an opposite end extending through the liner and open to the combustion chamber such that compressed working fluid in the flow passage flows into the combustion chamber; and wherein a straight portion of the outer tube extends axially within the annular passage with respect to a central axis of the combustion chamber.

2. The combustor as in claim 1, wherein the fuel injector further comprises a first section substantially parallel to the liner and a second section substantially perpendicular to the first section.

3. The combustor as in claim 1, further comprising a flow guide extending from the outer tube radially outward of the flow sleeve.

4. The combustor as in claim 1, further comprising an oleophobic coating on the inner tube.

5. The combustor as in claim 1, further comprising a baffle between the inner tube and the outer tube.

6. The combustor as in claim 1, further comprising a plurality of turbulators in the flow passage.

7. The combustor as in claim 1, further comprising a pre-filming member inside at least a portion of the inner tube.

8. The combustor as in claim 1, further comprising a liquid fuel supply extending through the flow sleeve and the outer tube and in fluid communication with the inner tube.

9. A combustor comprising:

a. a combustion chamber;

b. a liner surrounding at least a portion of the combustion chamber;

c. a flow sleeve surrounding at least a portion of the liner;

d. an annular passage between the liner and the flow sleeve;

e. an outer tube extending through the flow sleeve, along at least a portion of the annular passage, and through the liner into the combustion chamber;

f. an inner tube extending inside at least a portion of the outer tube, wherein a flow passage is formed between the inner tube and the outer tube; and g. at least one of a liquid or gaseous fuel supply outside of the annular passage and in fluid communication with the inner tube;

wherein the outer tube extends through the liner and is open to the combustion chamber such that compressed working fluid in the flow passage preheats the fuel supply in the inner tube before flowing into the combustion chamber; and wherein a straight portion of the outer tube extends axially within the annular passage with respect to a central axis of the combustion chamber.

10. The combustor as in claim 9, wherein the outer tube further comprises a first section substantially parallel to the liner and a second section at an obtuse angle with respect to the first section.

11. The combustor as in claim 9, further comprising an oleophobic coating on the inner tube.

12. The combustor as in claim 9, further comprising a flow guide extending from the outer tube radially outward of the flow sleeve.

13. The combustor as in claim 9, further comprising a baffle between the inner tube and the outer tube.

14. The combustor as in claim 9, further comprising a plurality of turbulators between the inner tube and the outer tube.

15. The combustor as in claim 9, further comprising a liquid fuel supply extending through the flow sleeve and the outer tube and in fluid communication with the inner tube.

* * * * *